US008438845B2

(12) United States Patent
O'Brien, II

(10) Patent No.: US 8,438,845 B2
(45) Date of Patent: May 14, 2013

(54) HOSELESS HYDRAULIC SYSTEM

(75) Inventor: James A. O'Brien, II, La Salle, MI (US)

(73) Assignee: Limo-Reid, Inc., Deerfield, MI (US)

( * ) Notice: Subject to any disclaimer, the term of this patent is extended or adjusted under 35 U.S.C. 154(b) by 931 days.

(21) Appl. No.: 12/547,798

(22) Filed: Aug. 26, 2009

(65) Prior Publication Data

US 2010/0050623 A1 Mar. 4, 2010

Related U.S. Application Data

(60) Provisional application No. 61/091,802, filed on Aug. 26, 2008.

(51) Int. Cl.
*F15B 15/18* (2006.01)
*F15B 1/02* (2006.01)

(52) U.S. Cl.
USPC ..... 60/413

(58) Field of Classification Search ..... 60/413
See application file for complete search history.

(56) References Cited

U.S. PATENT DOCUMENTS

| | | | | |
|---|---|---|---|---|
| 3,907,001 | A | 9/1975 | Vanderlaan et al. | |
| 4,738,595 | A * | 4/1988 | Gaiser | 417/36 |
| 4,924,670 | A * | 5/1990 | Bausch et al. | 60/418 |
| 5,354,187 | A * | 10/1994 | Holland et al. | 417/540 |
| 5,709,248 | A | 1/1998 | Goloff | |
| 5,771,936 | A | 6/1998 | Sasaki et al. | |
| 5,772,408 | A * | 6/1998 | Hada et al. | 417/313 |
| 5,906,221 | A * | 5/1999 | Mancell | 137/549 |
| 6,076,557 | A | 6/2000 | Carney | |
| 6,305,919 | B1 * | 10/2001 | Staton et al. | 417/540 |
| 6,478,051 | B1 | 11/2002 | Drumm et al. | |
| 6,524,147 | B1 * | 2/2003 | Hundertmark | 440/61 C |
| 6,598,553 | B1 * | 7/2003 | Hundertmark | 114/150 |
| 6,923,223 | B2 | 8/2005 | Trzmiel et al. | |
| 6,978,608 | B2 * | 12/2005 | Dantlgraber | 60/454 |
| 7,013,923 | B2 | 3/2006 | Suzuki | |
| 7,047,733 | B1 * | 5/2006 | Pecouyoul | 60/325 |
| 7,055,317 | B2 * | 6/2006 | Knapp et al. | 60/413 |
| 7,108,016 | B2 | 9/2006 | Moskalik et al. | |
| 7,281,372 | B2 * | 10/2007 | Sakai et al. | 60/434 |
| 7,296,407 | B2 * | 11/2007 | Rose | 60/414 |
| 7,354,511 | B2 * | 4/2008 | Becker | 210/167.02 |
| 7,591,330 | B2 * | 9/2009 | Kamman | 180/53.4 |
| 8,038,878 | B2 * | 10/2011 | Hewkin | 210/167.32 |
| 8,047,867 | B2 * | 11/2011 | Wu | 439/517 |
| 2007/0084516 | A1 | 4/2007 | Rose | |

* cited by examiner

*Primary Examiner* — Thomas E Lazo
(74) *Attorney, Agent, or Firm* — Fraser Clemens Martin & Miller LLC; William J. Clemens

(57) ABSTRACT

A hoseless hydraulic system is provided which addresses certain safety and efficiency issues known in the art. The hydraulic system includes a shell, an accumulator disposed within the shell, a hydraulic pump at least partly disposed within the shell, and at least one hydraulic motor at least partly disposed within the shell. High pressure fluid communication conduits are substantially located within the shell. The only communication across the shell boundary is mechanical power in, mechanical power out, control signals in, and sensor signals out.

20 Claims, 4 Drawing Sheets

HOSELESS HYDRAULIC SYSTEM

CROSS-REFERENCE TO RELATED APPLICATIONS

This application claims the benefit of U.S. Provisional Application No. 61/091,802, filed on Aug. 26, 2008. The entire disclosure of the above application is hereby incorporated herein by reference.

FIELD OF THE INVENTION

The present disclosure relates generally to high pressure hydraulic systems and, in particular, to high pressure hydraulic systems for hybrid vehicles.

BACKGROUND OF THE INVENTION

1. Closed Loop Hydraulic Systems.

Hydraulic systems typically include the following elements: a low-pressure reservoir; a pump; a high-pressure reservoir; an actuator; and various related lines, hoses, and fittings. A fluid is drawn from the low-pressure reservoir by the pump. The fluid is then stored in the high-pressure reservoir, also referred to as an accumulator, until the fluid is needed to motivate the actuator. Once the fluid has been used by the actuator, the fluid is returned to the low-pressure reservoir.

For any hydraulic systems application, minimizing power losses in the high pressure portion of the hydraulic system is critically important. It is known to use pipes and hoses to transport pressurized fluid between the various high pressure components. However, the pipes and hoses of the hydraulic system account for a large fraction of the lost power. In addition, the pipes and hoses are typically expensive, require precision fittings, are subject to failure, and are prone to leaking.

2. High Pressure Accumulator Designs in the State of the Art.

In the state of the art, there are three basic configurations for hydraulic accumulators, namely: spring type; bladder type; and piston type.

Spring type accumulators are typically limited to applications with small fluid volumes due to the size, cost, mass, and spring rates of the springs.

Bladder type accumulators typically suffer from high gas permeation rates and poor reliability. Some success has been achieved by replacing the elastic bladder with a flexible metallic or metallic-coated bellows structure, for example, as disclosed in U.S. Pat. No. 5,771,936 to Sasaki et al. and U.S. Pat. No. 6,478,051 to Drumm et al., the entire disclosures of which are hereby incorporated herein by reference.

Piston accumulators typically employ two chambers housed within a cylindrical pressure vessel, in which the hydraulic fluid is separated from the compressed gas by means of a piston which seals against the inner walls of the pressure vessel. The piston is also free to move longitudinally as fluid enters and leaves and the gas compresses and expands.

3. Safety Concerns Inherent with the State of the Art.

The high pressure components of the hydraulic system, and in particular hoses, pose a potential hazard to those nearby due to the energy contained therein. While the likelihood of a catastrophic failure of a pump or motor is relatively minor, hoses can easily rupture, especially if compromised in any manner.

Posing a significant potential hazard are the pipes and hoses in high pressure fluid communication with the accumulator, due to the energy they store. While one might envision a sudden rupture as the most potentially dangerous failure, a small hole also poses a significant threat as the escaping stream of the fluid may easily harm or damage an individual, for example, sever a human limb of a passerby.

As these concerns are well understood, designers employ large safety factors and/or configure the system in such a manner that the pressurized components are positioned far from possible human contact. For example, accumulators are typically designed with a safety factor of four, resulting in a device that is approximately four times heavier than theoretically needed.

Recent technological developments, such as the hydraulic hybrid power train, challenge both of these approaches. Since these power trains are intended for vehicular use, and are specifically employed because of the improvement in fuel economy they offer, they cannot be any heavier than necessary, nor can they be positioned remote from the vehicle's occupants.

Another method for addressing the problem of high pressure pipes and hose includes, for example, U.S. Patent Appl. Pub. No. 2007/0084516 to Rose, the entire disclosure of which is hereby incorporated herein by reference. Rose teaches the placement of the high-pressure reservoir within an outer casing. The outer casing both contains fluid and is itself pressurized, thereby insufficiently addressing the safety issue. Other art in which the outermost casing is a pressure vessel, includes U.S. Pat. No. 7,108,016 to Moskalik et al., U.S. Pat. No. 7,013,923 to Suzuki, U.S. Pat. No. 6,923,223 to Trzmiel et al., U.S. Pat. No. 6,076,557 to Carney, and U.S. Pat. No. 5,709,248 to Goloff, the entire disclosures of which are hereby incorporated herein by reference.

U.S. Pat. No. 3,907,001 to Vanderlaan and Boyle describes a combination accumulator reservoir device in a single package. The high pressure reservoir is fully exposed to the external environment and is vulnerable to the same shortcomings as the other art described hereinabove.

4. Thermal Inefficiencies with the Present State of the Art.

Another shortcoming of present piston type accumulators is thermal inefficiency due to the uncontrolled manner in which the energy flow associated with the compression and expansion of the gas is managed. When fluid is forced into the accumulator, the gas contracts and, in so doing, heats up. Since the temperature of the heated gas is typically greater than that of the surrounding, ambient environment, energy starts to flow from the gas to the ambient environment, thereby removing energy from the hydraulic system. When fluid is removed from the accumulator, the gas expands and its temperature decreases, though typically not below that of the ambient environment. Thus, not all of the energy that is stored in the gas can be extracted due to thermal interactions with the surrounding, ambient environment.

There is a continuing need for a high pressure hydraulic system that minimizes power loss and maximizes the safety of the hydraulic system. Desirably, the hydraulic system is comparatively inexpensive relative to prior art systems, and militates against leaking and failure within the hydraulic system.

SUMMARY OF THE INVENTION

In concordance with the instant disclosure, a high pressure hydraulic system that minimizes power loss, maximizes the safety of the hydraulic system, is comparatively inexpensive relative to known systems, and militates against leaking and failure within the hydraulic system, is surprisingly discovered.

In one embodiment, a hydraulic system includes a substantially fluid-tight shell having at least one accumulator disposed therein. An interstitial space is between the shell and the accumulator and forms a reservoir for a low pressure fluid. A first hydraulic motor is in fluid communication with the at least one accumulator and at least partially disposed within the shell. The first hydraulic motor is configured to transmit mechanical power to an external system.

In another embodiment, the hydraulic system also includes a hydraulic pump in fluid communication with the at least one accumulator and the first hydraulic motor. The hydraulic pump is disposed at least partially in the shell, and configured to generate a high pressure fluid for the at least one accumulator from the low pressure fluid in the reservoir.

In a further embodiment, the hydraulic system further includes a second hydraulic motor in fluid communication with the at least one accumulator and disposed outside of the shell. The second hydraulic motor is also configured to transmit mechanical power to the external system.

DRAWINGS

The above, as well as other advantages of the present disclosure will become readily apparent to those skilled in the art from the following detailed description, particularly when considered in the light of the drawings described herein.

DETAILED DESCRIPTION OF THE INVENTION

Figure 1:
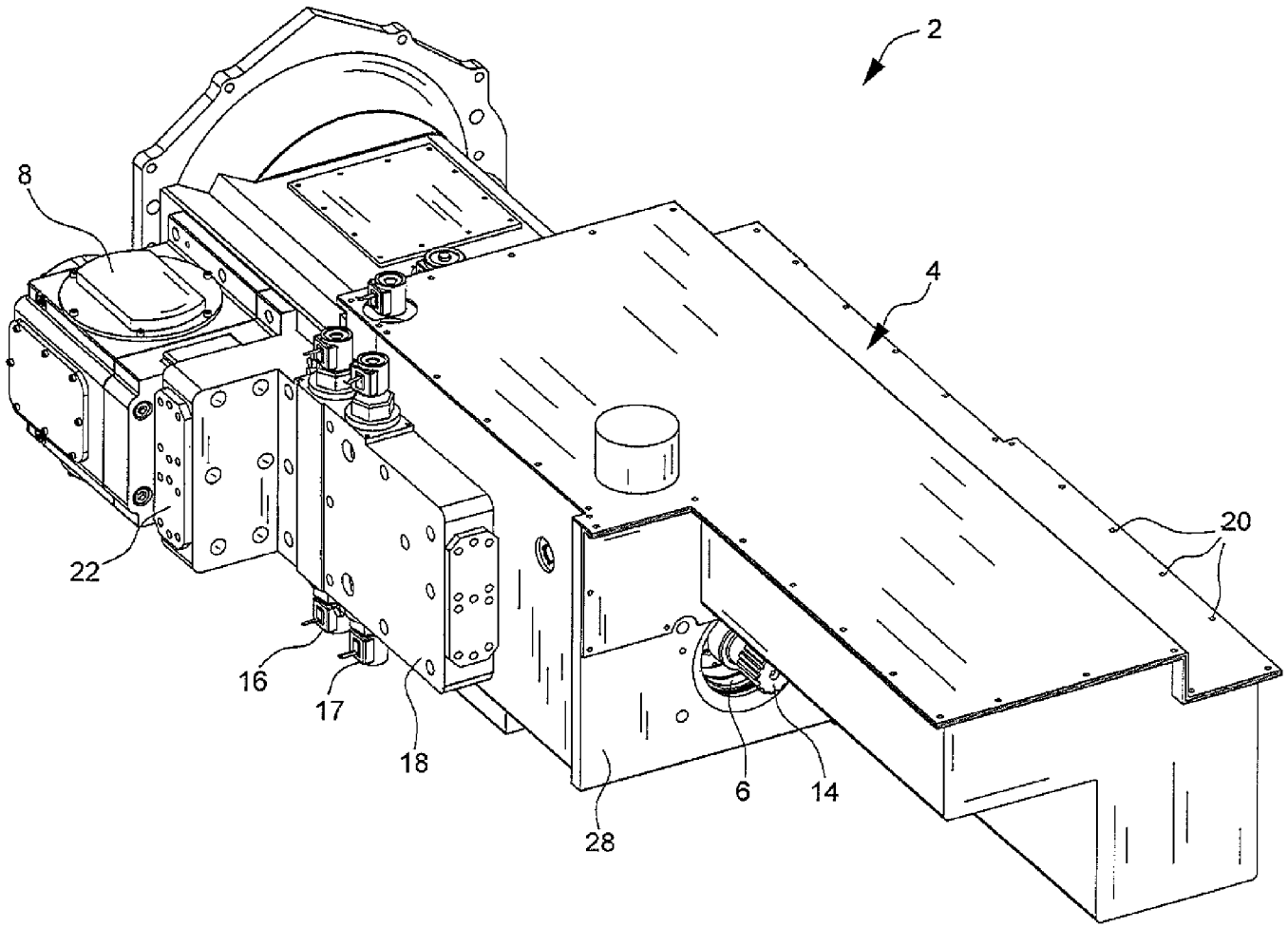
FIG. 1 shows a front perspective view of a hydraulic system according to the present disclosure.
Figure 2:
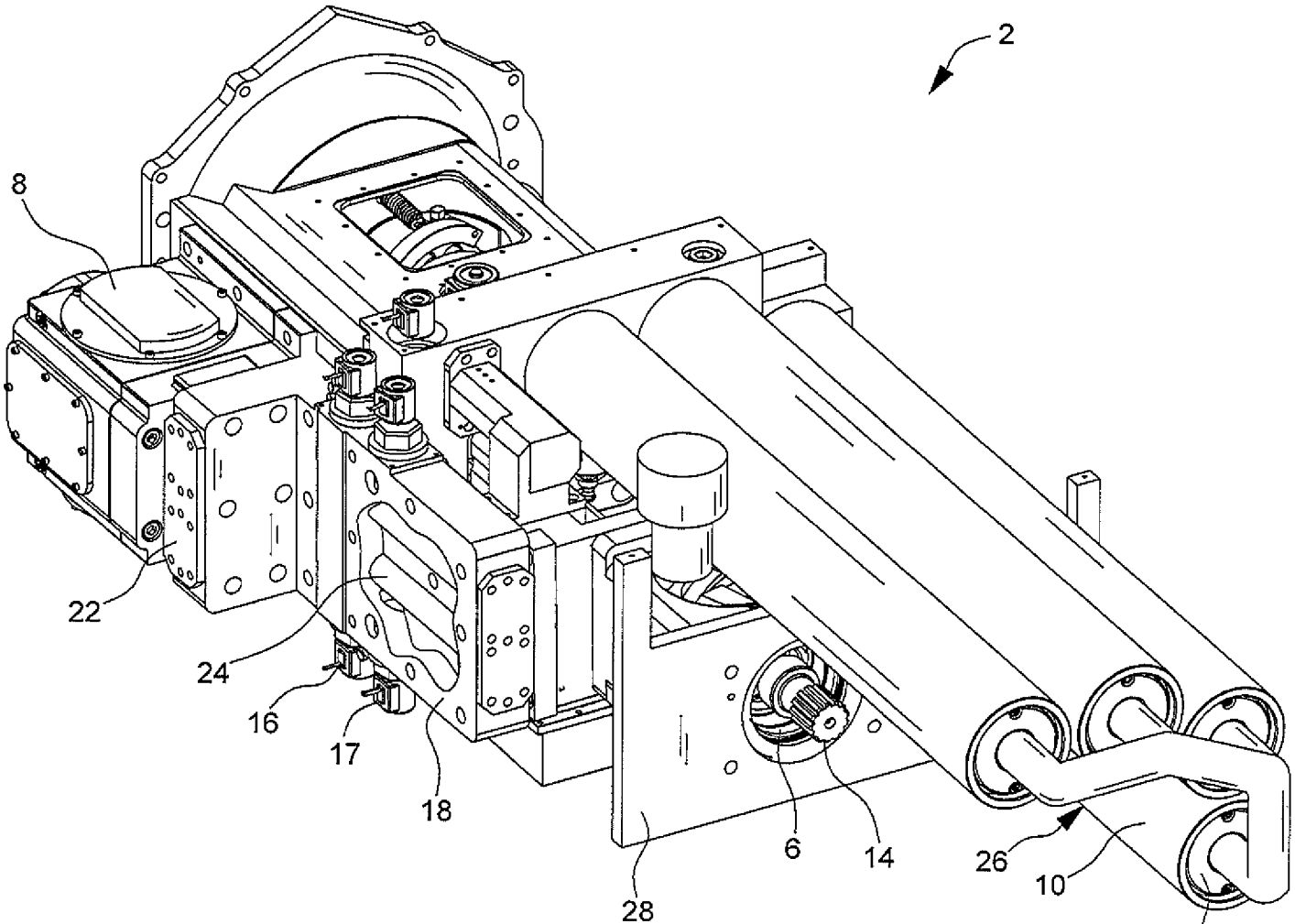
FIG. 2 shows a front perspective view of the hydraulic system depicted in FIG. 1 with a portion of a shell removed, and further showing internal components of the hydraulic system.

The following description is merely exemplary in nature and is not intended to limit the present disclosure, application, or uses: It should also be understood that throughout the drawings, corresponding reference numerals indicate like or corresponding parts and features.

An overall schematic representation of a hoseless hydraulic system 2 is shown in FIGS. 1 to 4. This embodiment of the invention has a first motor 6 contained within a substantially fluid-tight shell 4. An external second motor 8 is disposed outside of the shell 4. Also disposed within the shell 4 is an accumulator 10 having a least one accumulator tube 12. As a nonlimiting example, the accumulator 10 may include four of the accumulator tubes 12.

A first motor shaft 14 transmits mechanical power from the hydraulic system 2 to an external system (not shown), such as a hybrid vehicle, of which the hydraulic system 2 is a component. The hydraulic system 2 may also include at least one valve 16 and at least one sensor 17 to also communicate fluid and electrical signals, respectively, between the hydraulic system 2 and the external system. A manifold 18 of the hydraulic system 2 may also provide high and low pressure oil communication from the enshelled portion of the hydraulic system 2 to the external second motor 8.

The shell 4 may have any shape, as desired. The shell 4 may have a shape configured to be packaged within the external system, while still substantially enveloping the enshelled portion of the hydraulic system 2. For illustrative purposes, a plurality of bolt holes 20 are representative of topological features necessary for allowing the hydraulic system 2 to be packaged within the external system. It should be appreciated that the inclusion of any such topological feature, such as bends, shelves, holes, and protrusions, are fully within the scope of the present disclosure.

Means for fluid communication such as high pressure fluid conduits (not shown) provide fluid communication between the various components of the hydraulic system 2 within the substantially fluid-tight shell 4.

In one example, a cover plate 22 is employed to facilitate the machining of fluid passageways 24 within the manifold 18. The manifold 18 is illustrated partially exposed in FIG. 2 for purpose of showing the fluid passageways 24. The fluid passageways 24 may be machined through ports (not shown) in the manifold 18 that are sealed by the cover plate 22. The cover plate 22 may be attached to the manifold 18, for example, by welding or other fluid-tight means. The ports are not considered communication channels for hydraulic fluid because they are sealed with the cover-plate 22 when the system is operational.

The substantially fluid-tight shell 4 according to the present disclosure forms an interstitial space 26 between itself and the accumulator 10. The interstitial space 26 is filled with the hydraulic fluid under a low pressure, for example, less than about 100 psi. The interstitial space 26 forms a reservoir for the low pressure hydraulic fluid that is drawn upon by the hydraulic system 2. The shell 4 may be fabricated from any material capable of maintaining shape under the operating conditions of the hydraulic system 2. Since the hydraulic fluid contained within the interstitial space 26 is under the low pressure, materials such as aluminum, steel, fiberglass, and engineering thermoplastics may be employed. In a particular embodiment, the shell 4 is non-load bearing. At least one additional brace 28 may also be used to maintain a desired spacing between the active hydraulic components and the shell 4, thereby ensuring that the volume of the interstitial space 26 is adequate for the desired amount of low pressure hydraulic fluid.

Figure 3:
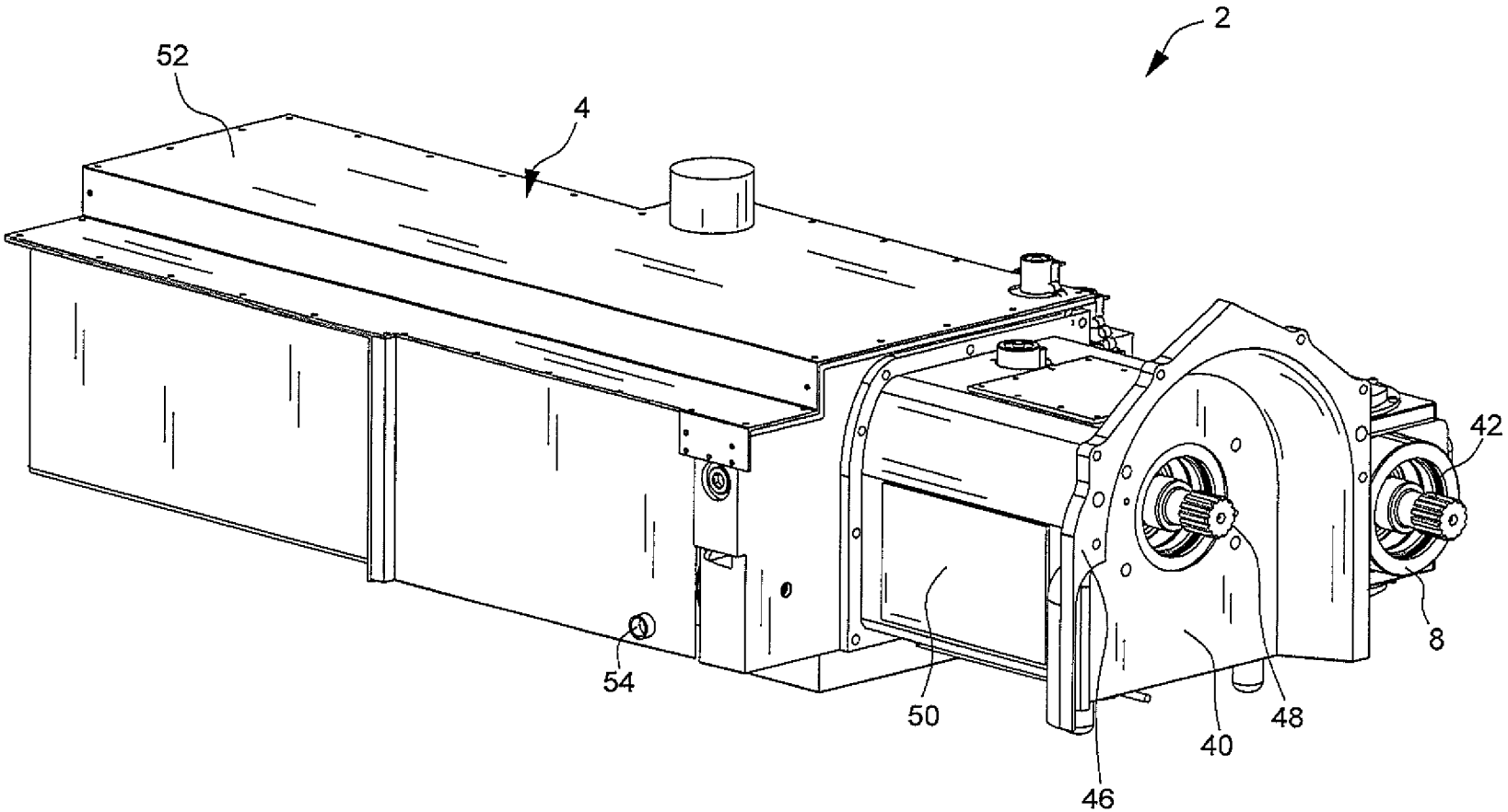
FIG. 3 shows a rear perspective view of the hydraulic system depicted in FIG. 1.
Figure 4:
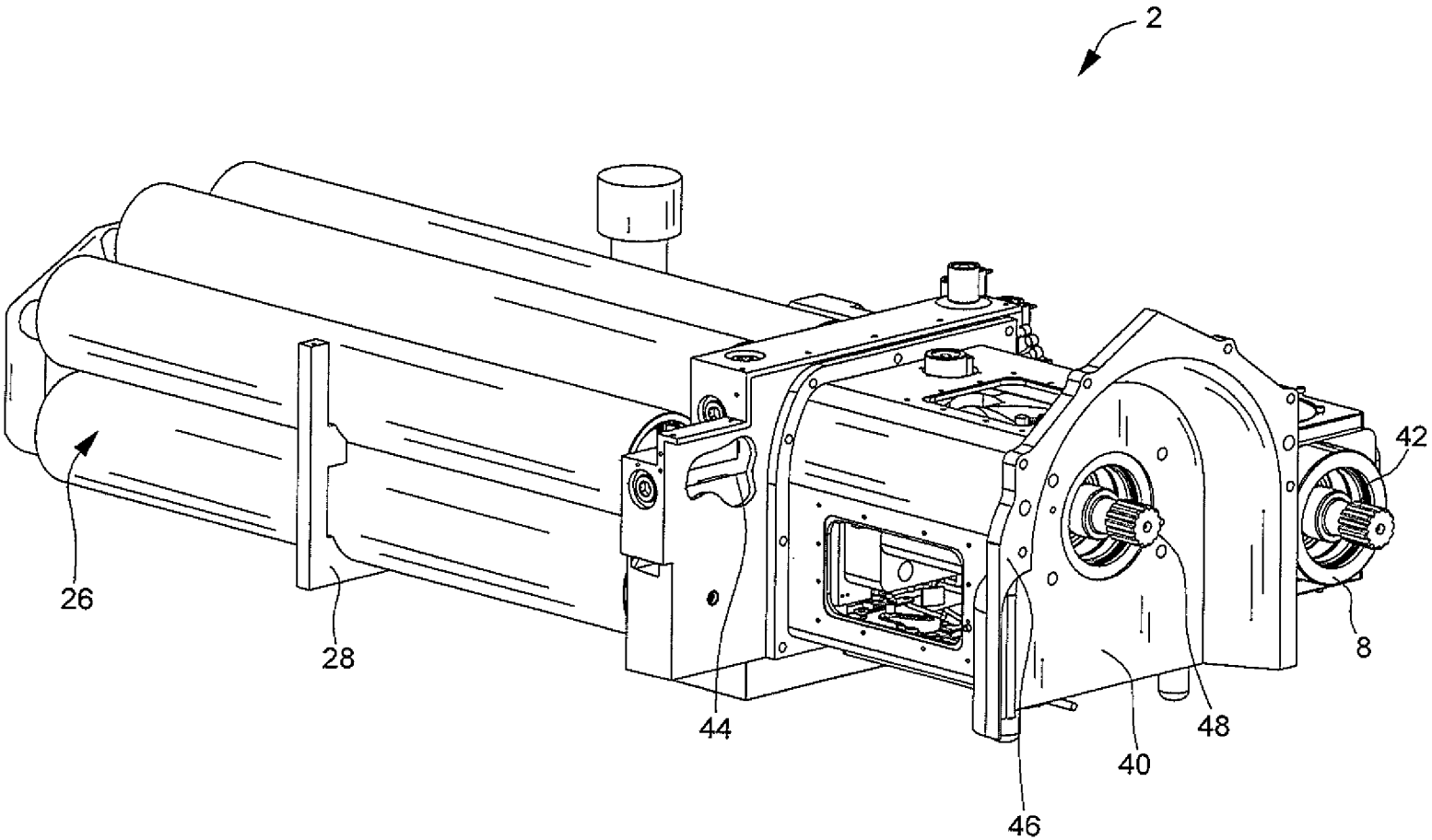
FIG. 4 shows a rear perspective view of the hydraulic system depicted in FIG. 2 with a portion of a shell removed, and further showing internal components of the hydraulic system.

Another representation of the hydraulic system 2 is shown in FIGS. 3 and 4. The hydraulic system 2 includes a hydraulic pump 40 for generating high pressure fluid. The hydraulic pump 40 is disposed within the shell 4 by a shell extension 50. The shell extension 50 is connected to, and in fluid communication with, the shell 4. The shell 4 has a plurality of lines 44 internal thereto for providing high pressure fluid communication between the hydraulic pump 40, the first and second motors or pumps 6, 8, the accumulator 26, and any other components requiring high pressure fluid in the hydraulic system 2.

Mechanical power communication into the hydraulic system 2 is provided by a pump shaft 48. To facilitate physical attachment of the hydraulic system 2 to the external system, an attachment plate 46 may optionally be employed as shown. The attachment plate 46 may be coupled to the shell 4 and adapted to couple the hydraulic system 2 to an external power source, for example. Output mechanical power from the hydraulic system 2 is provided by a motor shaft 42 of the externally located second motor 8.

To facilitate maintenance of system 2, the shell 4 may optionally include a panel 52 that is secured via removable fasteners such as bolts and the like. Upon removal of the panel 52, access to enshelled components such as the accumulator 26, the first hydraulic motor 6, and the lines 44, is permitted. Additionally, a plug 54 may be provided to allow selective draining of the low pressure hydraulic fluid from the shell 4, as desired.

It should be understood that the internal components of the hydraulic system 2 are completely housed within the reservoir of the low pressure hydraulic fluid, which is formed by the interstitial space 26 between the shell 4 and the accumulator 10. The hydraulic system 2 directly interconnects all high pressure hydraulic components internal to the shell 4. As is dictated by the hydraulic system 2 design considerations, certain external components are connected via the manifold 18, or in some cases, via hoses. It should be appreciated that the complete housing of the hydraulic system 2 within the low pressure reservoir enables the use of less expensive, non-pressure vessel rated materials for the casing shell 4.

One of ordinary skill in the art also understands that the present disclosure describes a piston type accumulator 10. However, it should be appreciated that the disclosure equally applies to spring and bladder types, as well. The hydraulic system 2 may be employed with any type of hydraulic motor 6, 8, including gear type, vane type, and piston type hydraulic motors 6, 8. The disclosure is also applicable to both fixed and variable displacement hydraulic motors 6, 8, as desired.

The hydraulic system 2 includes at least one hydraulic motor 6, at least one accumulator cylinder 10, and at least one hydraulic pump 40. These components are directly interconnected and are disposed within the reservoir formed by the interstitial space 26 between the various components and the shell 4. All hydraulic fluid, both high and low pressure, is contained within the shell 4. High pressure fluid is contained within the internal components or manifolds 18, and low pressure fluid is contained within the interstitial space 26. Fluid communication across the shell 4 is limited to mechanical power input and output, control inputs, and sensor outputs.

As described hereinabove, one or more second motors 8 may be external to the shell 4, due to specific packaging requirements of the external system. In such cases, the one or more second motors 8 are ideally connected to the hydraulic system 2 via the manifold 18 that transports both high and low pressure fluids from the enshelled hydraulic system 2 to the external one or more second motors 8. In certain embodiments, the one or more second motors 8 are connected to the enshelled hydraulic system 2 using the hydraulic hoses, lines, or passageways 24 of the manifold 18.

Advantageously, the hydraulic system 2 of the present disclosure addresses certain shortcomings with known accumulator designs previously identified herein. High pressure fluid seeking to escape containment must first pass through the low pressure fluid contained within the interstitial space 26, and would then need to penetrate the shell 4. In so doing, a significant fraction of the stored energy is depleted before the high pressure fluid escapes from the hydraulic system 2, thus providing protection for any passersby.

From a thermodynamics perspective, when the gas is compressed the excess heat is absorbed by the low pressure fluid in the reservoir formed by the interstitial space 26. Since the low pressure fluid remains in contact with the accumulator 10, when the gas expands, the heat is extracted from the low pressure fluid (as the low pressure fluid will typically be at a higher temperature than the gas). Thus, overall system efficiency is improved because heat energy is not lost to the surrounding, ambient environment.

While certain representative embodiments and details have been shown for purposes of illustrating the invention, it will be apparent to those skilled in the art that various changes may be made without departing from the scope of the disclosure, which is further described in the following appended claims.

What is claimed is:

1. A hydraulic system, comprising:

a substantially fluid-tight shell;

at least one accumulator disposed within the shell, an interstitial space between the shell and the accumulator forming a reservoir for a low pressure fluid; and a first hydraulic motor in fluid communication with the at least one accumulator and at least partially disposed within the shell, the first hydraulic motor configured to transmit mechanical power to an external system.

2. The hydraulic system of claim 1, further including at least one brace for maintaining a desired spacing between the at least one accumulator and the shell.

3. The hydraulic system of claim 1, wherein the shell is non-load bearing.

4. The hydraulic system of claim 1, wherein the shell includes a panel secured to the shell with a plurality of removable fasteners, the panel enabling selective access to an interior of the shell.

5. The hydraulic system of claim 1, wherein the accumulator includes a plurality of accumulator tubes.

6. The hydraulic system of claim 1, further including a second hydraulic motor in fluid communication with the at least one accumulator and disposed outside of the shell, the second hydraulic motor configured to transmit mechanical power to the external system.

7. The hydraulic system of claim 6, wherein means for the fluid communication between the second hydraulic motor and the accumulator is provided by a manifold coupled to the exterior of the shell.

8. The hydraulic system of claim 7, wherein the manifold includes internal fluid passageways for communication of a high pressure hydraulic fluid from the at least one accumulator to the second hydraulic motor.

9. The hydraulic system of claim 8, wherein the manifold has at least one cover plate attached to the manifold and sealing the internal fluid passageways for communication with the second hydraulic motor.

10. The hydraulic system of claim 1, wherein means for the fluid communication between the first hydraulic motor and the accumulator is disposed entirely within the shell.

11. The hydraulic system of claim 1, further including a hydraulic pump in fluid communication with the at least one accumulator and the first hydraulic motor and disposed at least partially in the shell, the hydraulic pump configured to generate a high pressure fluid for the at least one accumulator from the low pressure fluid in the reservoir.

12. The hydraulic system of claim 11, wherein the hydraulic pump is disposed within a shell extension coupled to the shell.

13. The hydraulic system of claim 11, wherein means for the fluid communication between the hydraulic pump, the first hydraulic motor and the accumulator is disposed entirely within the shell.

14. The hydraulic system of claim 1, including an attachment plate attached to the shell for mechanically coupling the hydraulic system to an external power source.

15. The hydraulic system of claim 1, wherein the first hydraulic pump and the accumulator are configured to hold a high pressure fluid, and the interstitial space is configured to hold the low pressure fluid, wherein all of the hydraulic fluid of the hydraulic system is disposed within the shell.

16. The hydraulic system of claim 15, wherein a drain plug is formed in the shell for selective draining of the low pressure fluid therefrom.

17. The hydraulic system of claim 1, further including at least one valve providing fluid communication between the hydraulic system and the external system.

18. The hydraulic system of claim 1, further including at least one sensor providing electrical communication between the hydraulic system and the external system.

19. A hydraulic system, comprising:

a substantially fluid-tight shell;

at least one accumulator disposed completely within the shell, an interstitial space between the shell and the accumulator forming a reservoir for a low pressure fluid;

a hydraulic motor in fluid communication with the at least one accumulator and at least partially disposed within the shell, the hydraulic motor configured to transmit mechanical power to an external system; and a hydraulic pump in fluid communication with the at least one accumulator and the hydraulic motor and disposed at least partially in the shell, the hydraulic pump configured to generate a high pressure fluid for the at least one accumulator from the low pressure fluid in the reservoir.

20. A hydraulic system, comprising:

a substantially fluid-tight shell;

at least one accumulator disposed completely within the shell, an interstitial space between the shell and the accumulator forming a reservoir for a low pressure fluid;

a first hydraulic motor in fluid communication with the at least one accumulator and at least partially disposed within the shell, the first hydraulic motor configured to transmit mechanical power to an external system;

a second hydraulic motor in fluid communication with the at least one accumulator and disposed outside of the shell, the second hydraulic motor configured to transmit mechanical power to the external system; and a hydraulic pump in fluid communication with the at least one accumulator and the first hydraulic motor and disposed at least partially in the shell, the hydraulic pump configured to generate a high pressure fluid for the at least one accumulator from the low pressure fluid in the reservoir.

* * * * *